US011142984B2

(12) United States Patent
Donald et al.

(10) Patent No.: US 11,142,984 B2
(45) **Date of Patent: *Oct. 12, 2021**

(54) APPARATUS, SYSTEMS AND METHOD FOR OIL AND GAS OPERATIONS

(71) Applicant: ENPRO SUBSEA LIMITED, Aberdeen (GB)

(72) Inventors: Ian Donald, Monymusk (GB); John Reid, Inchture (GB)

(73) Assignee: Enpro Subsea Limited, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/687,476

(22) Filed: Nov. 18, 2019

(65) Prior Publication Data

US 2020/0095842 A1 Mar. 26, 2020

Related U.S. Application Data

(63) Continuation of application No. 15/121,981, filed as application No. PCT/GB2015/054021 on Dec. 15, 2015, now Pat. No. 10,480,274.

(30) Foreign Application Priority Data

Dec. 15, 2014 (GB) ..... 1422308

(51) Int. Cl.
*E21B 33/035* (2006.01)
*E21B 33/038* (2006.01)
(Continued)

(52) U.S. Cl.
CPC ..... *E21B 33/076* (2013.01); *E21B 33/035* (2013.01); *E21B 33/038* (2013.01);
(Continued)

(58) Field of Classification Search
CPC .... E21B 33/035; E21B 33/038; E21B 33/076; E21B 37/06; E21B 43/01; E21B 43/013; E21B 49/08
See application file for complete search history.

(56) References Cited

U.S. PATENT DOCUMENTS 3,973,587 A 8/1976 Cochran
4,047,695 A 9/1977 Cleveland et al.
(Continued)

FOREIGN PATENT DOCUMENTS

GB 2377425 1/2003
WO 0047864 8/2000
(Continued)

OTHER PUBLICATIONS

Office action dated Feb. 9, 2015 from U.S. Appl. No. 14/396,658, filed Oct. 23, 2014.
(Continued)

*Primary Examiner* — Matthew R Buck
(74) *Attorney, Agent, or Firm* — David B. Tingey; Bryant J. Keller; Kirton McConkie

(57) ABSTRACT

The invention provides an apparatus and system for accessing a flow system (such as a subsea tree) in a subsea oil and gas production installation, and method of use. The apparatus comprises a body and a plurality of connectors configured to connect the apparatus to the flow system. A flow access interface is provided on the body for connecting the apparatus to a subsea process apparatus, and the body defines a plurality of flow paths. Each flow path fluidly connects one of the plurality of connectors to the flow access interface to provide an intervention path from a connected subsea process apparatus to the flow system in use. Aspects of the invention have particular application to flow metering, fluid sampling, and well scale squeeze operations.

20 Claims, 11 Drawing Sheets

(51) Int. Cl.

| | |
|---|---|
| ***E21B 33/076*** | (2006.01) |
| ***E21B 43/013*** | (2006.01) |
| *E21B 37/06* | (2006.01) |
| *E21B 43/01* | (2006.01) |
| *E21B 49/08* | (2006.01) |

(52) U.S. Cl.
CPC ..... *E21B 43/013* (2013.01); *E21B 37/06* (2013.01); *E21B 43/01* (2013.01); *E21B 49/08* (2013.01)

(56) References Cited

U.S. PATENT DOCUMENTS

| | | | | |
|---|---|---|---|---|
| 4,540,022 | A | 9/1985 | Cove | |
| 4,748,011 | A | 5/1988 | Baize | |
| 6,460,620 | B1 | 10/2002 | LaFleur | |
| 6,460,621 | B2 * | 10/2002 | Fenton | E21B 47/10 166/347 |
| 6,481,504 | B1 | 11/2002 | Gatherar | |
| 6,536,528 | B1 | 3/2003 | Amin et al. | |
| 6,698,520 | B2 * | 3/2004 | Fenton | E21B 34/04 166/347 |
| 6,776,188 | B1 | 8/2004 | Rajewski | |
| 6,973,936 | B2 | 12/2005 | Watson | |
| 7,040,408 | B2 | 5/2006 | Sundararajan et al. | |
| 7,219,740 | B2 | 5/2007 | Saucier | |
| 7,757,772 | B2 | 7/2010 | Donohue et al. | |
| 8,181,705 | B2 | 5/2012 | Tveiten et al. | |
| 8,186,440 | B2 | 5/2012 | Tveiten et al. | |
| 8,297,360 | B2 * | 10/2012 | Donald | E21B 33/035 166/364 |
| 8,327,875 | B2 * | 12/2012 | Grace | E21B 33/076 137/487.5 |
| 8,376,050 | B2 | 2/2013 | Cumming et al. | |
| 8,550,170 | B2 * | 10/2013 | McHugh | E21B 34/045 166/351 |
| 8,763,693 | B2 | 7/2014 | Mchugh et al. | |
| 8,931,561 | B2 * | 1/2015 | Baker | E21B 41/10 166/341 |
| 9,169,709 | B2 * | 10/2015 | Vincent | E21B 34/02 |
| 9,365,271 | B2 * | 6/2016 | Minnock | E21B 34/04 |
| 9,611,714 | B2 * | 4/2017 | Donald | E21B 33/0387 |
| 10,480,274 | B2 * | 11/2019 | Donald | E21B 33/035 |
| 2003/0056955 | A1 | 3/2003 | Watson | |
| 2005/0070150 | A1 | 3/2005 | Williams | |
| 2006/0108120 | A1 | 5/2006 | Saucier | |
| 2010/0059221 | A1 | 3/2010 | Vannuffelen et al. | |
| 2011/0061854 | A1 | 3/2011 | Davies | |
| 2011/0192609 | A1 | 8/2011 | Tan et al. | |
| 2012/0006556 | A1 * | 1/2012 | McHugh | E21B 37/06 166/344 |
| 2012/0111571 | A1 | 5/2012 | Eriksen | |
| 2012/0199358 | A1 | 8/2012 | Larsson | |
| 2013/0000918 | A1 * | 1/2013 | Voss | E21B 34/04 166/344 |
| 2013/0206420 | A1 | 8/2013 | Mchugh et al. | |
| 2015/0027730 | A1 * | 1/2015 | Hall | E21B 33/038 166/379 |
| 2015/0136409 | A1 | 5/2015 | Hall et al. | |
| 2016/0369598 | A1 | 12/2016 | Smedstad | |

FOREIGN PATENT DOCUMENTS

| | | | | |
|---|---|---|---|---|
| WO | WO-0047864 | A1 * | 8/2000 | E21B 33/038 |
| WO | 00/70185 | | 11/2000 | |
| WO | 2005-047646 | | 5/2005 | |
| WO | 2005-083228 | | 9/2005 | |
| WO | 2007-016678 | | 2/2007 | |
| WO | 2012/107727 | | 8/2012 | |
| WO | 2013-121212 | | 8/2013 | |
| WO | 2013/126592 | | 8/2013 | |
| WO | WO-2013121212 | A2 * | 8/2013 | E21B 33/035 |
| WO | 2014031122 | | 2/2014 | |
| WO | WO-2013126592 | A9 * | 7/2014 | E21B 34/04 |

OTHER PUBLICATIONS

International Search Report dated Apr. 7, 2014 from International Patent Application No. PCT/GB2013/051058 filed Apr. 26, 2013.
International Preliminary Report on Patentability dated Oct. 28, 2014 from International Patent Application No. PCT/GB2013/051058 filed Apr. 26, 2013.
Office action dated Sep. 3, 2015 from U.S. Appl. No. 14/396,660, filed Oct. 23, 2014.
Office action dated Sep. 29, 2015 from U.S. Appl. No. 14/396,658, filed Oct. 23, 2014.
Office action dated Aug. 6, 2015 from U.S. Appl. No. 14/379,277, filed Aug. 15, 2014.
Office action dated Feb. 29, 2016 from U.S. Appl. No. 14/379,277, filed Aug. 15, 2014.
Office action dated Feb. 3, 2016 from U.S. Appl. No. 14/396,660, filed Oct. 23, 2014.
Office action dated Mar. 21, 2016 from U.S. Appl. No. 14/396,660, filed Oct. 23, 2014.
Notice of Allowance dated Apr. 6, 2016 from U.S. Appl. No. 14/396,658, filed Oct. 23, 2014.
International Search Report and Written Opinion dated Jul. 19, 2016 from International Patent Application No. PCT/GB2015/054021 filed Dec. 15, 2015.
Ian Donald et al: "Using MARS (Multiple Application Re-Injection System (Technology for Improving Oil Recovery and Reducing Production Risk," Proceedings of International Oil and Gas Conference and Exhibition in China, Jun. 8, 2010, XP055063295, DOI: 10.2118/132274-MS, ISBN: 978-1-55-563295-3.
Tordis Personal Handbook Subsea Equipment, Statoil, FMC Technologies, Jan. 2008, Industriell Dokumentasjon as, Kongsberg, Norway.

* cited by examiner

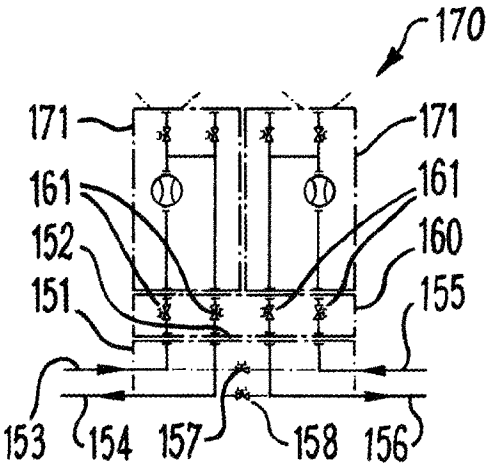
Fig. 9A
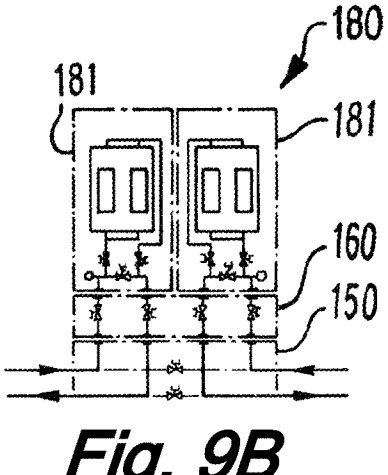
Fig. 9B
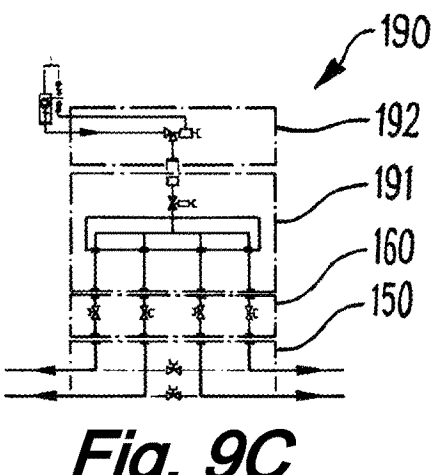
Fig. 9C
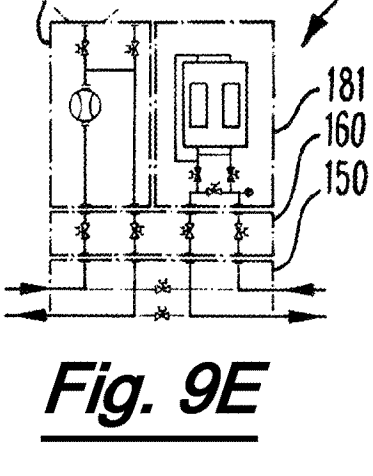
Fig. 9D
Fig. 9E
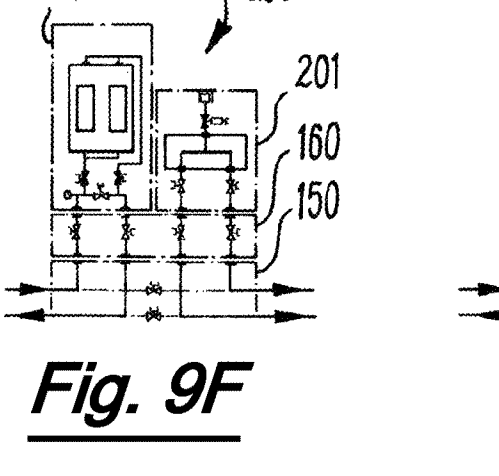
Fig. 9F
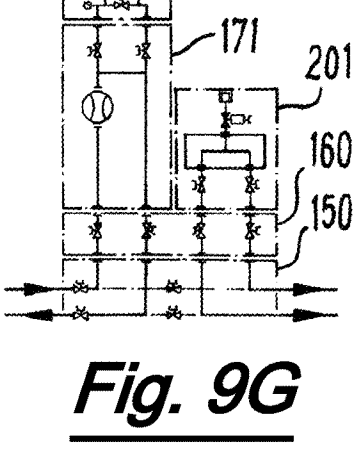
Fig. 9G

APPARATUS, SYSTEMS AND METHOD FOR OIL AND GAS OPERATIONS

RELATED APPLICATIONS

This application is a continuation of U.S. application Ser. No. 15/121,981, which was filed Aug. 26, 2016, which is a National Stage Application of PCT/GB2015/054021, filed Dec. 15, 2015, which designates the U.S. and claims the priority of GB patent application 1422308.5, filed Dec. 15, 2014; the entire disclosures of which are incorporated herein by reference.

The present invention relates to apparatus, systems and methods for oil and gas operations, in particular to apparatus, systems and methods for fluid intervention in oil and gas production or injection systems. The invention has particular application to subsea oil and gas operations, and aspects of the invention relate specifically to apparatus, systems and methods for fluid intervention in subsea oil and gas production and injection infrastructure.

BACKGROUND TO THE INVENTION

In the field of oil and gas exploration and production, it is common to install an assembly of valves, spools and fittings on a wellhead for the control of fluid flow into or out of the well. A Christmas tree is a type of fluid manifold used in the oil and gas industry in surface well and subsea well configurations and have a wide range of functions, including chemical injection, well intervention, pressure relief and well monitoring. Christmas trees are also used to control the injection of water or other fluids into a wellbore to control production from the reservoir.

There are a number of reasons why it is desirable to access a flow system in an oil and gas production system. In the context of this specification, the term "fluid intervention" is used to encapsulate any method which accesses a flow line, manifold or tubing in an oil and gas production, injection or transportation system. This includes (but is not limited to) accessing a flow system for fluid sampling, fluid diversion, fluid recovery, fluid injection, fluid circulation, fluid measurement and/or fluid metering. This can be distinguished from full well intervention operations, which generally provide full (or near full) access to the wellbore. Full well intervention processes and applications are often technically complex, time-consuming and have a different cost profile to fluid intervention operations. It will be apparent from the following description that the present invention has application to full well intervention operations. However, it is an advantage of the invention that full well intervention may be avoided, and therefore preferred embodiments of the invention provide methods and apparatus for fluid intervention which do not require full well intervention processes.

International patent application numbers WO00/70185, WO2005/047646, and WO2005/083228 describe a number of configurations for accessing a hydrocarbon well via a choke body on a Christmas tree.

Although a choke body provides a convenient access point in some applications, the methods of WO00/70185, WO2005/047646, and WO2005/083228 do have a number of disadvantages. Firstly, a Christmas tree is a complex and carefully—designed piece of equipment. The choke performs an important function in production or injection processes, and its location on the Christmas tree is selected to be optimal for its intended operation. Where the choke is removed from the choke body, as proposed in the prior art, the choke must be repositioned elsewhere in the flow system to maintain its functionality. This compromises the original design of the Christmas tree, as it requires the choke to be located in a sub-optimal position.

Secondly, a choke body on a Christmas tree is typically not designed to support dynamic and/or static loads imparted by intervention equipment and processes. Typical loads on a choke body in normal use would be of the order of 0.5 to 1 tonnes, and the Christmas tree is engineered with this in mind. In comparison, a typical flow metering system as contemplated in the prior art may have a weight of the order of 2 to 3 tonnes, and the dynamic loads may be more than three times that value. Mounting a metering system (or other fluid intervention equipment) on the choke body therefore exposes that part of the Christmas tree to loads in excess of those that it is designed to withstand, creating a risk of damage to the structure. This problem may be exacerbated in deepwater applications, where even greater loads may be experienced due to thicker and/or stiffer components used in the subsea infrastructure.

In addition to the load restrictions identified above, positioning the flow intervention equipment on the choke body may limit the access available to large items of process equipment and/or access of divers or remotely operated vehicles (ROVs) to the process equipment or other parts of the tree.

Furthermore, modifying the Christmas tree so that the chokes are in non-standard positions is generally undesirable. It is preferable for divers and/or ROV operators to be completely familiar with the configuration of components on the Christmas tree, and deviations in the location of critical components are preferably avoided.

Another drawback of the prior art proposals is that not all Christmas trees have chokes integrated with the system; approaches which rely on Christmas tree choke body access to the flow system are not applicable to these types of tree.

WO2013/121212 describes an apparatus and system for accessing a flow system such as a subsea tree, which addresses drawbacks of choke-mounted flow access, by providing a flow access apparatus which can be used at a variety of access points away from the choke and optionally away from the subsea tree. The apparatus and methods of WO2013/121212 enable a range of fluid intervention operations, including fluid sampling, fluid diversion, fluid recovery, fluid injection, fluid circulation, fluid measurement and/or fluid metering.

SUMMARY OF THE INVENTION

It is amongst the aims and objects of the invention to provide an apparatus, a system and a method of use for accessing a flow system in an oil and gas production installation, which is an alternative to the apparatus and methods described in the prior art.

It is amongst the aims and objects of the invention to provide apparatus, a system and a method of use for fluid intervention in an oil and gas production installation, which addresses one or more drawbacks of the prior art.

An object of the invention is to provide a flexible apparatus, system and method of use suitable for use with and/or retrofitting to industry standard or proprietary oil and gas production manifolds, including subsea trees, and/or end terminations.

Further objects and aims of the invention will become apparent from the following description.

According to a first aspect of the invention there is provided a flow access apparatus for a flow system in a subsea oil and gas production installation, the flow access apparatus comprising:

a body;

a plurality of connectors configured to connect the apparatus to the flow system; and a flow access interface for connecting the apparatus to a subsea process apparatus;

wherein the body defines a plurality of flow paths, and each flow path fluidly connects one of the plurality of connectors to the flow access interface to provide an intervention path from a connected subsea process apparatus to the flow system in use.

The subsea process apparatus is preferably a fluid intervention apparatus, which may be a fluid intervention apparatus for fluid sampling, fluid diversion, fluid recovery, fluid injection, fluid circulation, fluid measurement and/or fluid metering.

Preferably the flow access apparatus provides full bore access between the subsea process apparatus and the flow system. For example, at least one of the flow paths of the flow access apparatus may comprise an inner diameter not less than about 3 inches (75 mm). In some embodiments, each of the flow paths of the flow access apparatus may comprise an inner diameter not less than 3 inches (75 mm). In some embodiments, one or more of the flow paths of the flow access apparatus may comprise an inner diameter not less than about 4 inches (100 mm).

The flow access interface is preferably a single interface and therefore may provide a single connection point and/or landing point for the subsea process apparatus. However, the flow access apparatus provides selective access to the flow system via the flow paths of the body and therefore enables a range of intervention operations from a single flow access interface.

The flow access interface may comprise a plurality of flow access openings in a unitary connector, wherein the plurality of flow access openings correspond to respective flow paths. The unitary connector may comprise a unitary face or plate with the plurality of flow access openings formed therein.

By providing a single flow access interface and a plurality of flow paths, the invention facilitates convenient landing on and/or connection of a subsea process apparatus for performing an intervention operation. The flow access apparatus comprising a single flow access interface facilitates the use of subsea process apparatus of shape and form which are operationally straightforward to deploy or run, land and connect, and disconnect and retrieve from the flow access site. The invention therefore offers particular advantages as part of a system or kit of modular components, each of which may be interchangeably connected and removed from the flow access apparatus.

Preferably, the subsea process apparatus comprises a process module. The process module may be selected from one of a number of process modules, performing the same, similar and/or complementary functions.

The process module may be selected from a group of process modules comprising at least two modules selected from the group comprising: a flow metering module; a fluid sampling module; a fluid injection module; a flow bypass module; and a flow cap module.

The body of the flow access apparatus comprises multiple flow paths or bores, and the flow access apparatus may therefore be considered as a multi-bore apparatus.

In some embodiments of the invention, the body of the flow access apparatus comprises a pair of flow paths, and the flow access apparatus may therefore be considered as a dual bore apparatus. One of the flow paths or bores may be connected between a production bore of a subsea well and a subsea process apparatus in use, and/or one of the flow paths or bores may be connected between the subsea process apparatus and a production flow line (such as a jumper flow line).

In some embodiments of the invention, the body of the flow access apparatus comprises a plurality of flow paths greater than two. The flow paths may be configured to connect multiple subsea wells to subsea process apparatus in use, and the flow access apparatus may therefore be considered as a multi-well apparatus. For example, the flow access apparatus may comprise a body defining four flow paths or bores. A first of the flow paths or bores may be connected between a production bore of a first subsea well and a subsea process apparatus in use, and/or a second of the flow paths or bores may be connected between the subsea process apparatus and a production flow line (such as a jumper flow line) of the first subsea well. A third of the flow paths or bores may be connected between a production bore of a second subsea well and a subsea process apparatus in use, and/or a fourth of the flow paths or bores may be connected between the subsea process apparatus and a production flow line (such as a jumper flow line) of the second subsea well.

The flow paths or bores may be arranged in functional pairs.

Preferably, the flow access apparatus is an access hub configured for connection to the flow system. A first connector of the flow access apparatus may be configured to be connected to an external opening on the flow system. For example, the first connector may be configured to be connected to a flange of the flow system. The flow system may comprise a blind flange, removal of which provides a flange connection point for the flow access apparatus.

Where the flow system comprises a subsea Christmas tree, the external opening may be downstream of a wing valve of the subsea tree.

The external opening may be a flow line connector, such as a flow line connector for a jumper flow line. A second connector of the flow access apparatus may be configured for connecting the apparatus to a downstream flow line such as a jumper flow line. Therefore the apparatus may be disposed between a flow line connector and a jumper flow line, and may provide an access point for the flow system from the subsea process apparatus in use, and may also establish an access point to the jumper flow line from the subsea process apparatus in use.

According to a second aspect of the invention, there is provided a subsea oil and gas production installation comprising:

a subsea well and a subsea flow system in communication with the subsea well;

and a flow access apparatus;

wherein the flow access apparatus comprises:

a body;

a plurality of connectors configured to connect the apparatus to the flow system; and a flow access interface for connecting the apparatus to a subsea process apparatus;

wherein the body defines a plurality of flow paths, and each flow path fluidly connects one of the plurality of connectors to the flow access interface to provide an intervention path from a connected subsea process apparatus to the flow system in use.

Embodiments of the second aspect of the invention may include one or more features of the first aspect of the invention or its embodiments, or vice versa.

According to a third aspect of the invention, there is provided a method of performing a subsea intervention operation, the method comprising:

providing a subsea well and a subsea flow system in communication with the well;

providing a flow access apparatus on the subsea flow system, the flow access apparatus comprising;

a body; a plurality of connectors, and a flow access interface for connecting the apparatus to a subsea process apparatus;

wherein the body defines a plurality of flow paths, and each flow path fluidly connects one of the plurality of connectors to the flow access interface;

providing a subsea process apparatus on the flow access interface;

accessing the subsea flow system via an intervention path formed through one of the flow paths defined by the body to one of the first or second connectors.

Preferably the method comprises connecting the subsea process apparatus to the flow access interface.

Preferably the method is a method of performing a fluid intervention operation. The method may comprise fluid sampling, fluid diversion, fluid recovery, fluid injection, fluid circulation, fluid measurement and/or fluid metering.

The method may be a method of performing a well scale squeeze operation.

The method may comprise performing a well fluid sampling operation. An embodiment of the invention comprises: (a) performing a fluid injection operation; and (b) performing a well fluid sampling operation.

A flow line connector for a jumper flow line may be a preferred location for the connection of the access hub. This is because it is displaced from the Christmas tree sufficiently to reduce associated spatial access problems and provides a more robust load bearing location compared with locations on the Christmas tree itself (in particular the choke body). However, it is still relatively near to the tree and the parts of the flow system to which access is required for the intervention applications.

The flow access apparatus may be configured to be connected to the flow system at a location selected from the group consisting of: a jumper flow line connector; downstream of a jumper flow line or a section of a jumper flow line; a Christmas tree; a subsea collection manifold system; subsea Pipe Line End Manifold (PLEM); a subsea Pipe Line End Termination (PLET); and a subsea Flow Line End Termination (FLET).

Preferably the flow access apparatus is pre-installed on the subsea flow system and left in situ at a subsea location for later performance of a subsea intervention operation. The intervention apparatus may then be connected to the pre-installed access hub and the method performed.

Embodiments of the third aspect of the invention may include one or more features of the first or second aspects of the invention or their embodiments, or vice versa.

According to a fourth aspect of the invention, there is provided a system for accessing a flow system in a subsea oil and gas production installation, the system comprising:

a flow access apparatus according to the first aspect of the invention;

a plurality of process modules, each process module configured to be connected to the flow access apparatus;

wherein the plurality of process modules comprises at least two modules selected from the group comprising a flow metering process module; a fluid sampling process module; a fluid injection process module; a flow bypass module; and a flow cap module.

Embodiments of the fourth aspect of the invention may include one or more features of the first to third aspects of the invention or their embodiments, or vice versa.

According to a fifth aspect of the invention, there is provided a subsea process module for a subsea oil and gas production installation, the process module comprising:

a first module interface for connection with a flow access apparatus of the subsea oil and gas production installation;

a second module interface for connection of a second subsea process module.

Embodiments of the fifth aspect of the invention may include one or more features of the first to fourth aspects of the invention or their embodiments, or vice versa.

BRIEF DESCRIPTION OF THE DRAWINGS

There will now be described, by way of example only, various embodiments of the invention with reference to the drawings, of which:

FIGS. 9A to 9G are schematic process and instrumentation diagrams of assemblies according to further alternative embodiments of the invention;

DETAILED DESCRIPTION OF PREFERRED EMBODIMENTS

Figure 1A:
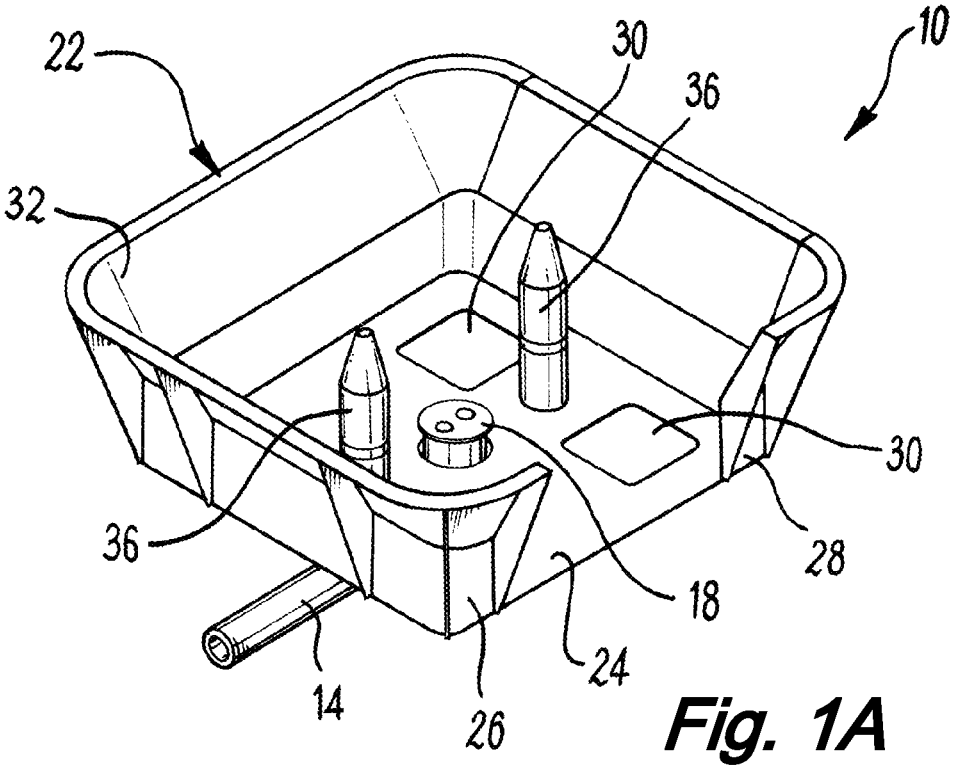
FIGS. 1A and 1B are respectively isometric and sectional views through a flow access apparatus according to a first embodiment of the invention.
Figure 1B:
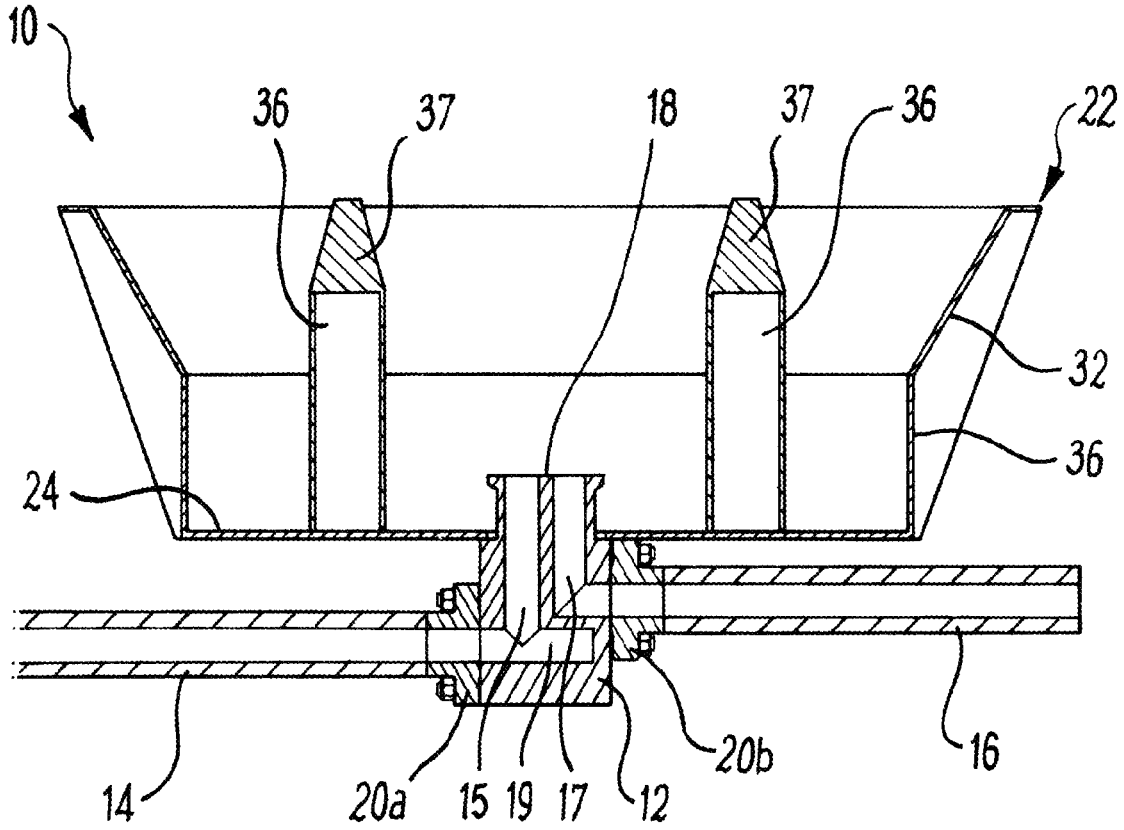

Referring firstly to FIGS. 1A and 1B, there is shown in isometric and sectional views a flow access apparatus according to a first embodiment of the invention. The flow access apparatus, generally depicted at 10, is designed to provide access to a flow system which forms part of a subsea hydrocarbon production system or installation. The flow access apparatus comprises a body 12, which is shown connected to first and second flow lines 14 and 16. In this embodiment, the connection between the first and second flow lines 14 and 16 and the body 12 is made up by flange connectors 20*a*, 20*b*. In this example, first flow line 14 receives production fluid from a subsea tree (not shown) and second flow line 16 is connected to a subsea manifold or end termination.

The body defines a flow access interface, generally shown at 18, which in this embodiment is upward facing and arranged substantially vertically. The apparatus of this embodiment is configured as a dual bore hub, which is capable of connection to flow lines 14 and 16, and provides flow paths from each of the flow line connectors to the flow access interface. In alternative embodiments, the apparatus may be configured in a multi-bore configuration, with greater than two bores which define flow paths between multiple flow line connectors and the flow access interface.

A first flow access bore 15 extends from the first connector 20*a* to the flow access interface. A second flow access bore 17 provides a flow path between the second connector 20*b* and the flow access interface. The body 12 also defines a blind mixing tee 19 which extends into the body from the first connector. The mixing tee 19 facilitates mixing of a multiphase production fluid before it passes into the process equipment through the flow access interface 18.

The body 12 extends through an opening in the base plate 24, and is upstanding from the base plate to define a single interface with first and second flow access openings to the bores 15, 17. Therefore a first flow access opening provides an intervention path to subsea tree and ultimately the wellbore to which the first flow line 14 is connected; a second flow access opening provides a flow path to the second flow line and ultimately the manifold or end termination to which the flow line 16 is connected.

The apparatus 10 provides a convenient single interface for process equipment to be landed on the apparatus and is therefore a convenient means for enabling a variety of wellbore intervention operations as will be described in more detail below.

The apparatus 10 comprises a guide structure, generally shown at 22, which facilitates placement, alignment and location of process equipment on the interface 18. The guide structure 22 comprises a rectangular (in this example, substantially square) base plate 24, partially surrounded by a wall 26. In this embodiment, the wall 26 surrounds three sides of the base plate, but a fourth side 28 is substantially open along the majority of the length of the side. Apertures 30 are provided in the base plate.

Located above the wall 26 is a skirt or flared wall portion 32 which extends around the same three sides of the base plate as the wall 26. The flared wall portion 32 defines an upward facing receiving funnel which assists with the initial alignment of deployment or retrieval tools (not shown) during landing or retrieval of the equipment.

The apparatus 10 also comprises a pair of upward pointing guideposts 36, which extend upwards from the base plate. The guideposts 36 are sized and shaped to be received in corresponding openings at the bottom of the process equipment. An upper end of each guidepost 36 has a frusto-conical portion 37 which assists with alignment and placement of the process module when it is landed on the apparatus 10.

Figure 2:
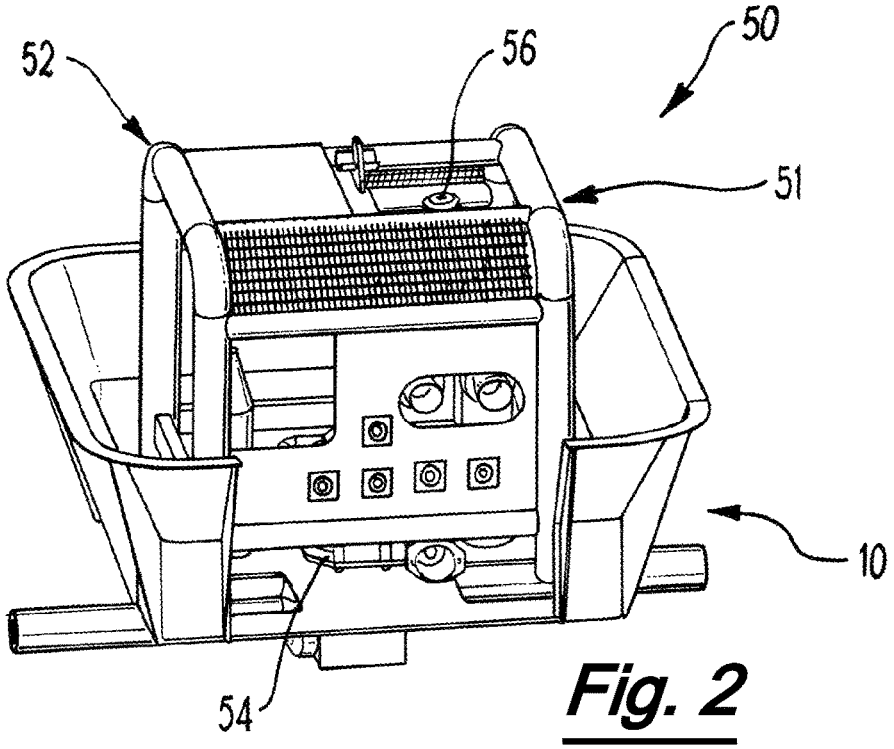
FIG. 2 is an isometric view of an assembly consisting of the flow access point of FIGS. 1A and 1B, and a process module according to an embodiment of the invention.

Referring now to FIG. 2, there is shown an isometric view of an assembly comprising the apparatus 10 and process equipment in the form of a scale squeeze module. The scale squeeze module, generally depicted at 50, comprises a frame 52, a lower interface 54, an upper flow connector 56 and an internal arrangement of flow lines and valves. The assembly is formed by lowering the module 50 onto the apparatus 10 with the assistance of the guide structure 22. The lower interface 54 is connected to the flow access interface 18.

Figure 3:
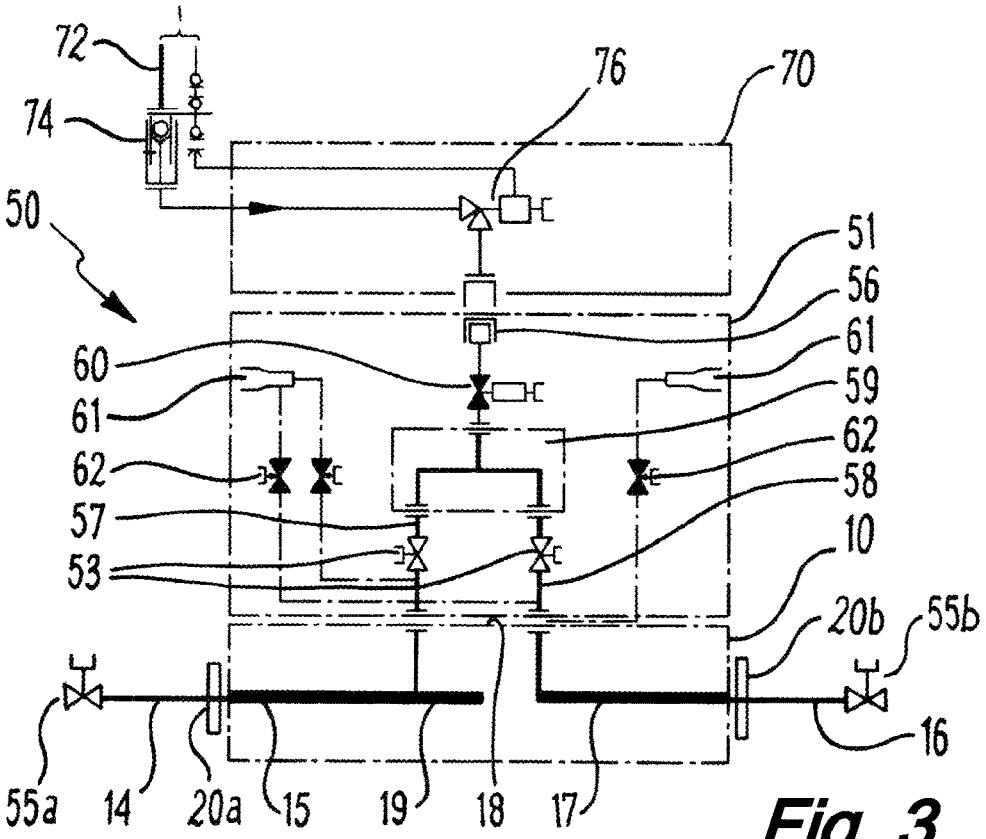
FIG. 3 is a schematic process and instrumentation diagram of the assembly of FIG. 2.

FIG. 3 is a schematic process and instrumentation diagram of the assembly 50 comprising the module 51 and the apparatus 10. The assembly 50 of this embodiment is configured for installation in a "greenfield" or new oilfield development that has isolation valves 55*a*, 55*b*, incorporated into the subsea infrastructure. Isolation valves 55*a*, 55*b* may therefore provide flow shut off functionality for the flow paths 15, 17 of the flow access apparatus.

As shown in FIG. 3, the module 51 comprises a pair of flow lines 57, 58 which are configured to be connected to the first and second flow access openings of the interface 18. The flow lines 57, 58 are connected into an integrated flow cap 59 which functions as to manifold the flow lines to the upper flow connector 56. ROV actuated valves 53 are provided in line between the flow access interface 18 and the flow cap 59. An hydraulically actuated shut-off valve 60 with ROV override is provided inline between the flow cap and the flow connector 56. ROV hot stab connectors 61 are provided in the module along with ROV operated valves 62, and together enable controlled provision of hydraulic or system fluids, for example for flushing of internal lines.

The assembly 50 is shown in FIG. 3 with an injection hose termination device 70 connected to the flow connector 56. The hose termination 70 functions to connect an injection hose 72 to the module 51, via a weak link 74. The hose termination comprises an internal flow control valve 76 which enables the injection rate to be controlled.

In use, the assembly 50 enables a subsea injection operation, and in particular a well scale and squeeze operation, to be performed using the module 51 mounted on the apparatus 10. Injection fluid can be delivered from the hose 72 to the production bore via the flow line 57, the flow access bore 15, and the flow line 14 (while being prevented from passing into the flow line 16 by respective isolation valve 53 in flow line 58). After the operation is complete, the hose termination 70 can be removed and the flow of production fluid can be resumed with the module 51 still in place, but closing valve 61 and opening valves 53, to use the flow cap 59 as a bypass between flow lines 57 and 58).

If desired, the module 51 can be removed from the apparatus 10 and a dedicated flow cap module, which provides a bypass between the flow bores 15 and 17, can be connected to the apparatus to enable production flow to be resumed.

The flow access apparatus is a convenient and effective means of landing and connecting, and conversely disconnecting and retrieving, process flow equipment for a dedicated flow intervention process.

Figure 4B:
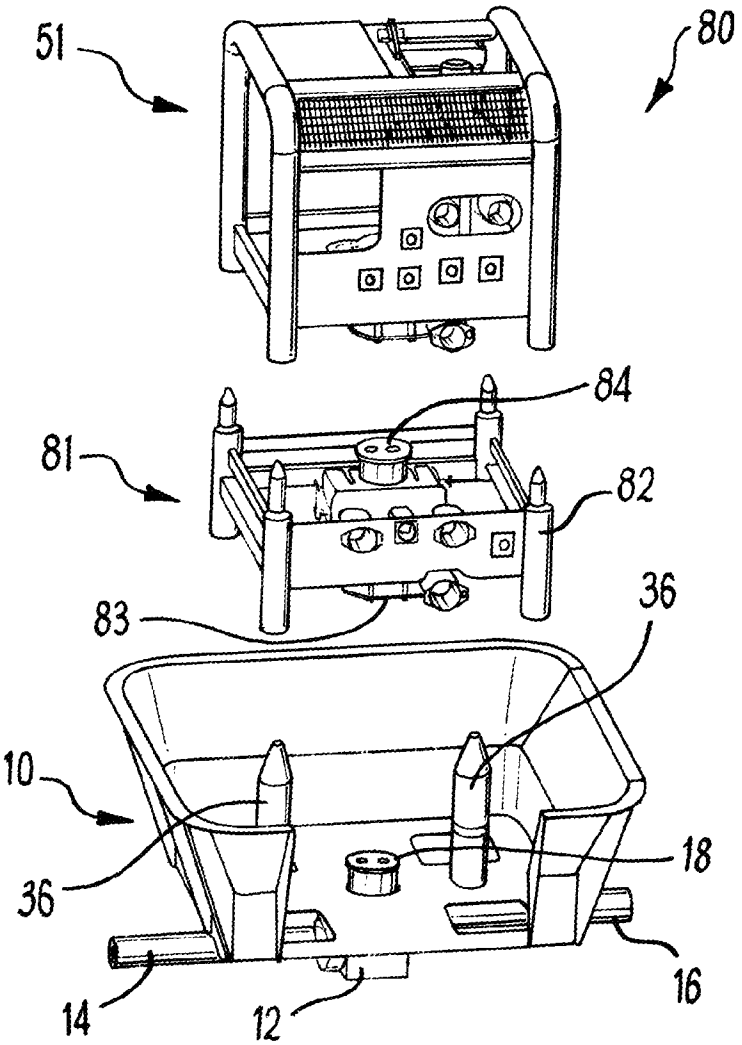
FIGS. 4A and 4B are respectively isometric and exploded isometric views of an assembly of a flow access point, a process module and a valve skid according to an alternative embodiment of the invention.
Figure 4A:
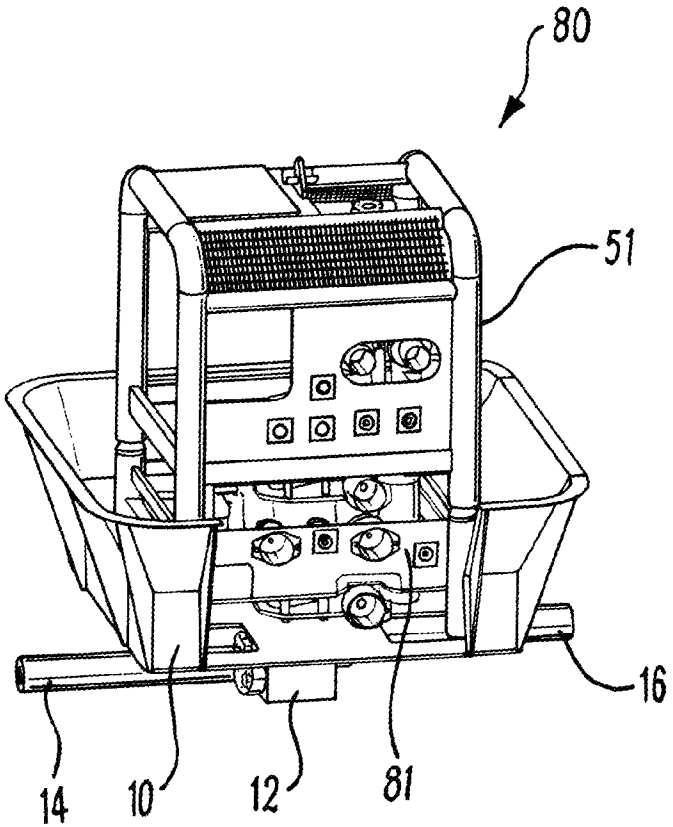
Figure 5:
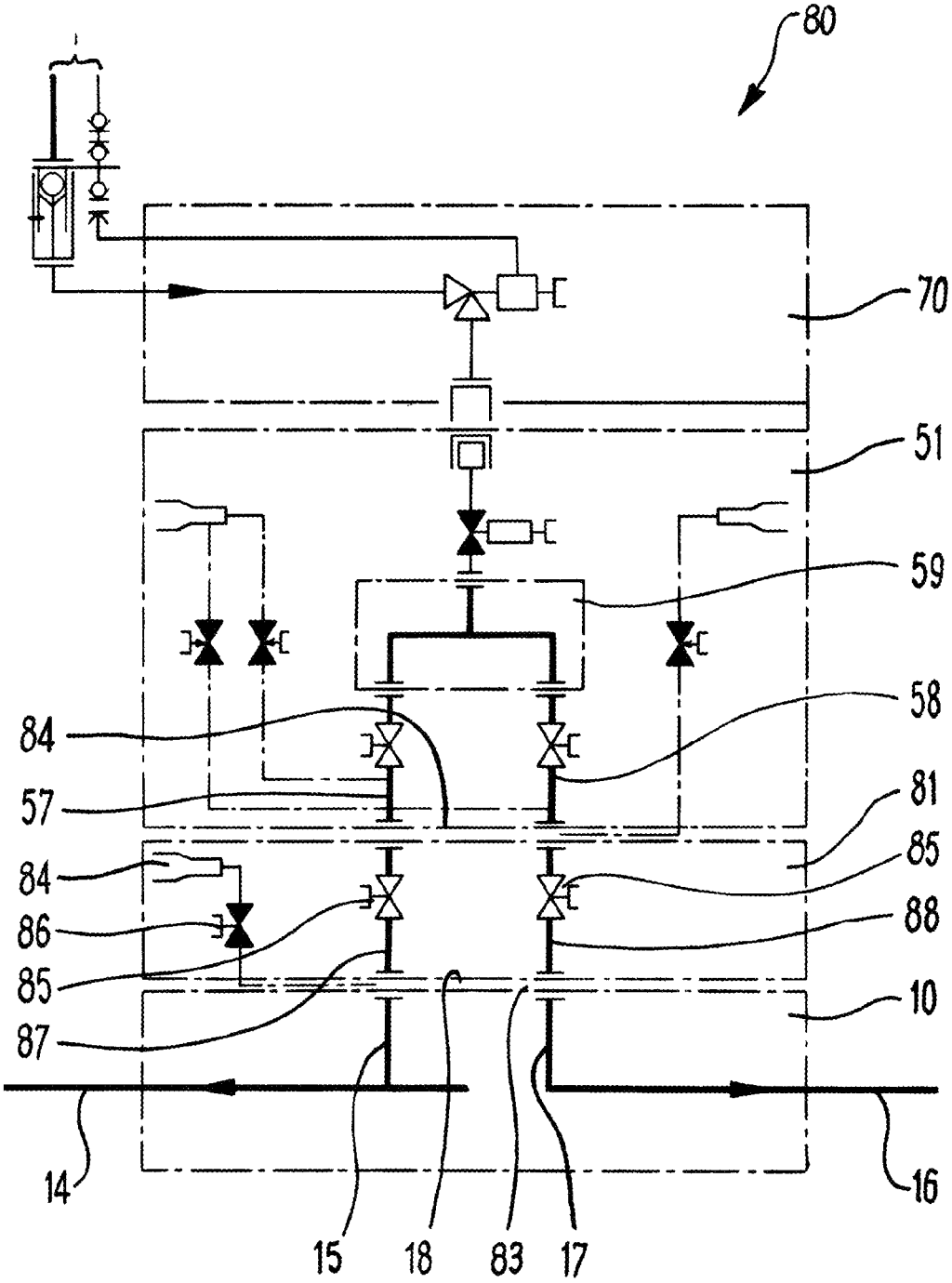
FIG. 5 is a schematic process and instrumentation diagram of the assembly of FIGS. 4A and 4B.

Referring now to FIGS. 4A, 4B and 5, there is shown an alternative embodiment of the invention which provides additional flexibility of application to "brownfield" developments or existing oilfield infrastructure. The drawings show generally at 80 an assembly consisting of an apparatus 10, a subsea process module in the form of a scale squeeze module 51, and an intermediate valve skid 81. FIG. 4A is an isometric view of the assembly, FIG. 4B is an exploded isometric view, and FIG. 5 is a schematic process and instrumentation diagram of the assembly with a connected hose termination device 70.

In this embodiment, apparatus 10, module 51 and hose termination 70 are the same as those described with reference to FIGS. 2 and 3. However, in this embodiment the apparatus 10 is installed in subsea infrastructure that does not have isolation valves incorporated in the flow lines 14, 16. The assembly is therefore provided with a valve skid 81. The valve skid 81 comprises a frame 82, a lower interface 83 for connection to the flow access interface 18, and an upper interface 84. The upper interface 84 is the same shape and form as the flow access interface 18, and enables the lower interface of the module 51 to connect to the valve skid 81. In addition, the guide posts 36 are sufficiently long to extend through the vertical height of the valve skid 81 to be received in apertures of the module 51. The valve skid 81 is separable from the module 51, and therefore the module can be removed, leaving the valve skid 81 in situ on the apparatus 10.

As shown in FIG. 5, the valve skid 81 comprises a pair of flow lines 87, 88, which connect to the flow lines 15, 17 of the apparatus 10, and which are in fluid communication with the flow lines 57, 58 of the module 51. ROV-operated isolation valves 85 are provided in the flow lines 87, 88 and enabled the flow lines 14, 16 to be isolated, for example during connection and disconnection of modules on the valve skid. ROV hot stab connector 84 is provided on the valve skid along with ROV operated valves 86, and together the hot stab and valve enable controlled provision of hydraulic or system fluids, for example for flushing of internal lines.

The assembly 80 may be operated in the same way as the assembly 50 to perform a scale squeeze operation on a well. However, this case, flow of fluids passes through the valve skid 81. When the operation is complete, and if the module 81 is removed from the assembly, the valve skid 81 provides isolation of the production bore and the flow line 16 from the subsea environment until a flow cap or further process module is installed on the valve skid and apparatus.

It will be appreciated that the principles of the above-described system can be applied to process modules other than the scale squeeze module 50 described with reference to FIG. 3. For example, a process module may be a flow metering module; a fluid sampling module; a fluid injection module; a flow bypass module; and/or a flow cap module.

Figure 6:
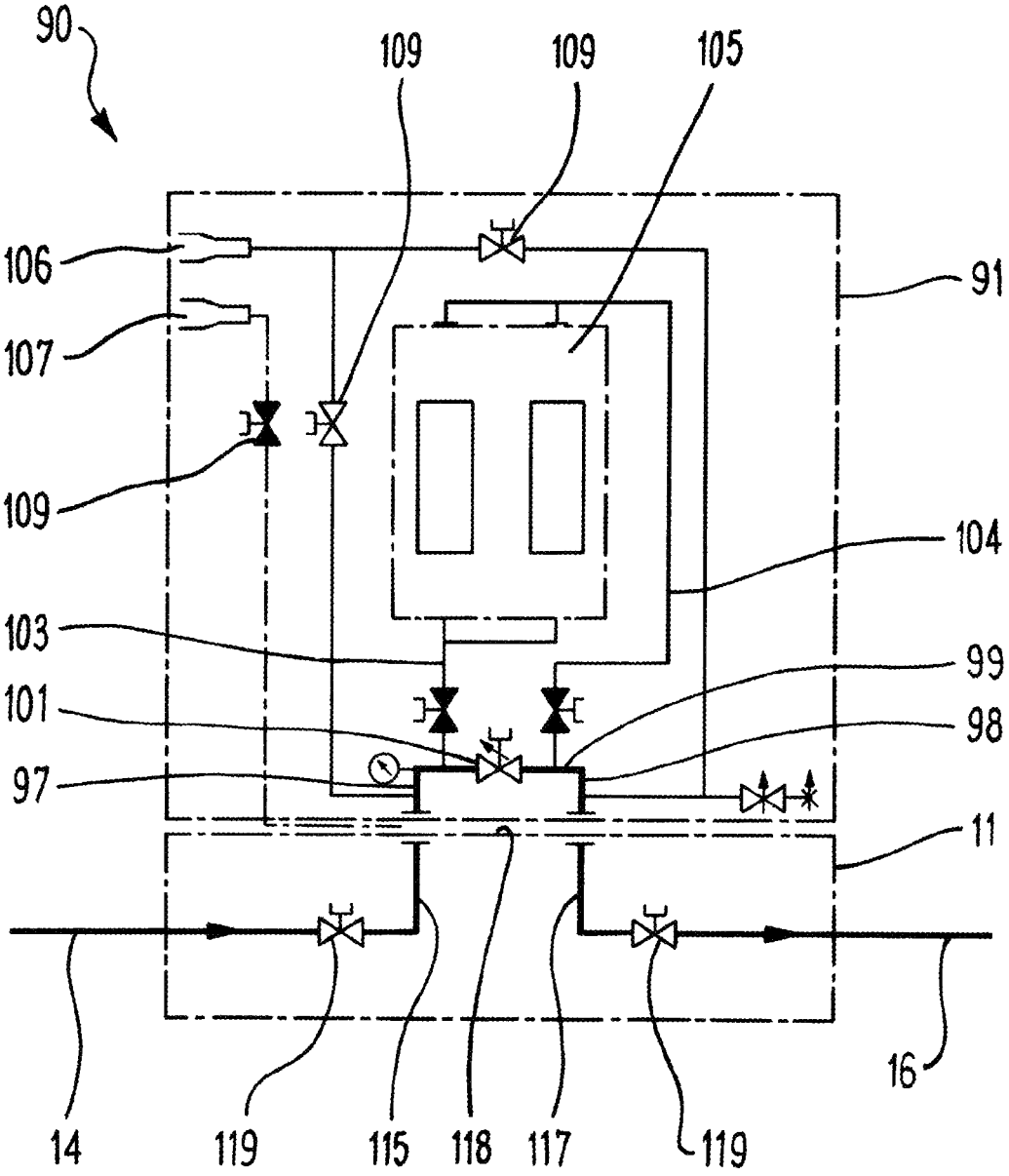
FIG. 6 is a schematic process and instrumentation diagram of an assembly according to an alternative embodiment of the invention.

An example of a fluid sampling module is shown schematically as a process and instrumentation diagram in FIG. 6; the module 91 is shown in an assembly 90 with an apparatus 11. In the assembly 90, the apparatus 11 differs from the apparatus 10, in that the flow bores 115, 117, which respectively connect the first flow line 14 and the second flow line with the flow access interface 118, comprise integrated isolation valves 119. This enables the flow access apparatus 11 to be used in a brownfield site, which lacks separate isolation valves in the flow lines 14, 16, without the provision of a valve skid 81.

The module 91 comprises a lower interface 92 which is designed to connect with the flow access interface 118 of the apparatus 11. A pair of flow lines 97, 98 are connected by a flow bypass line 99. An ROV operated valve 101 is inline in the bypass and enables the module to be selectively operated in a sampling mode or a bypass mode. Valve controlled sampling lines 103, 104 connect the flow lines 97, 98 to a pair of sampling bottles 105. ROV hot stab connectors 106, 107 are provided on the module along with ROV operated valves 108, 109, and together the hot stabs and valves enable controlled delivery of hydraulic or system fluids, for example for flushing of the sampling modules.

Figure 7:
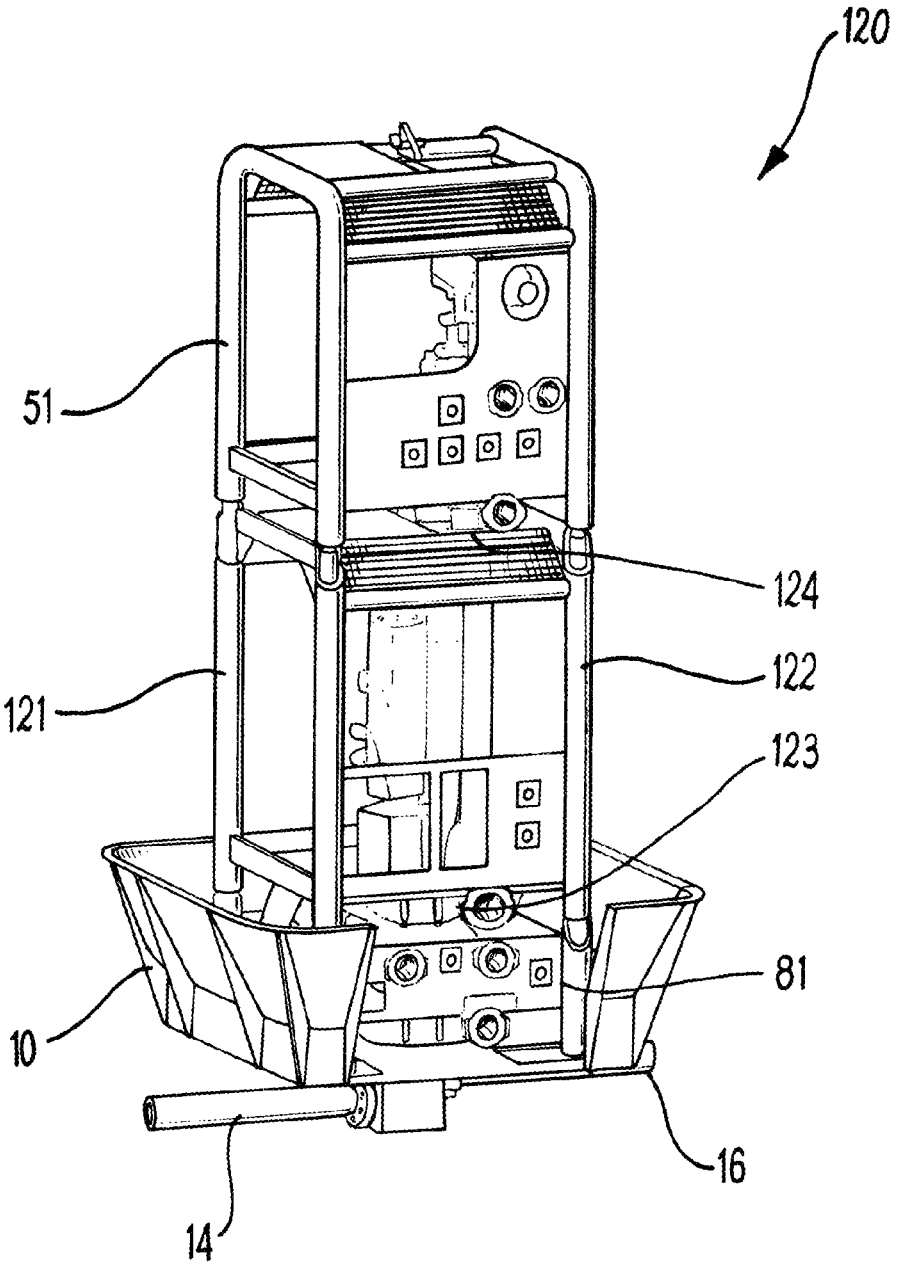
FIG. 7 is an isometric view of an assembly according to an alternative embodiment of the invention.

An alternative embodiment of the invention is described with reference to FIGS. 7 and 8. In this embodiment, an assembly 120 is configured with a pair of stacked modules 51 and 121 on a flow access apparatus 10 and a valve skid 81. The apparatus 10, the module 51, and the valve skid 81 are the same as previously described. Module 121 is a multiphase flow metering module, and comprises a frame 122 and a lower interface 123 configured to be connected to the flow access interface 18 of the apparatus 10. The module 121 differs from the modules according to previous embodiments, in that is provided with a second (upper) interface 124. The upper interface 124 is the same shape and form as the flow access interface 18 and the upper interface of the valve skid module, and enables the lower interface of the module 51 to connect to the module 121.

Figure 8:
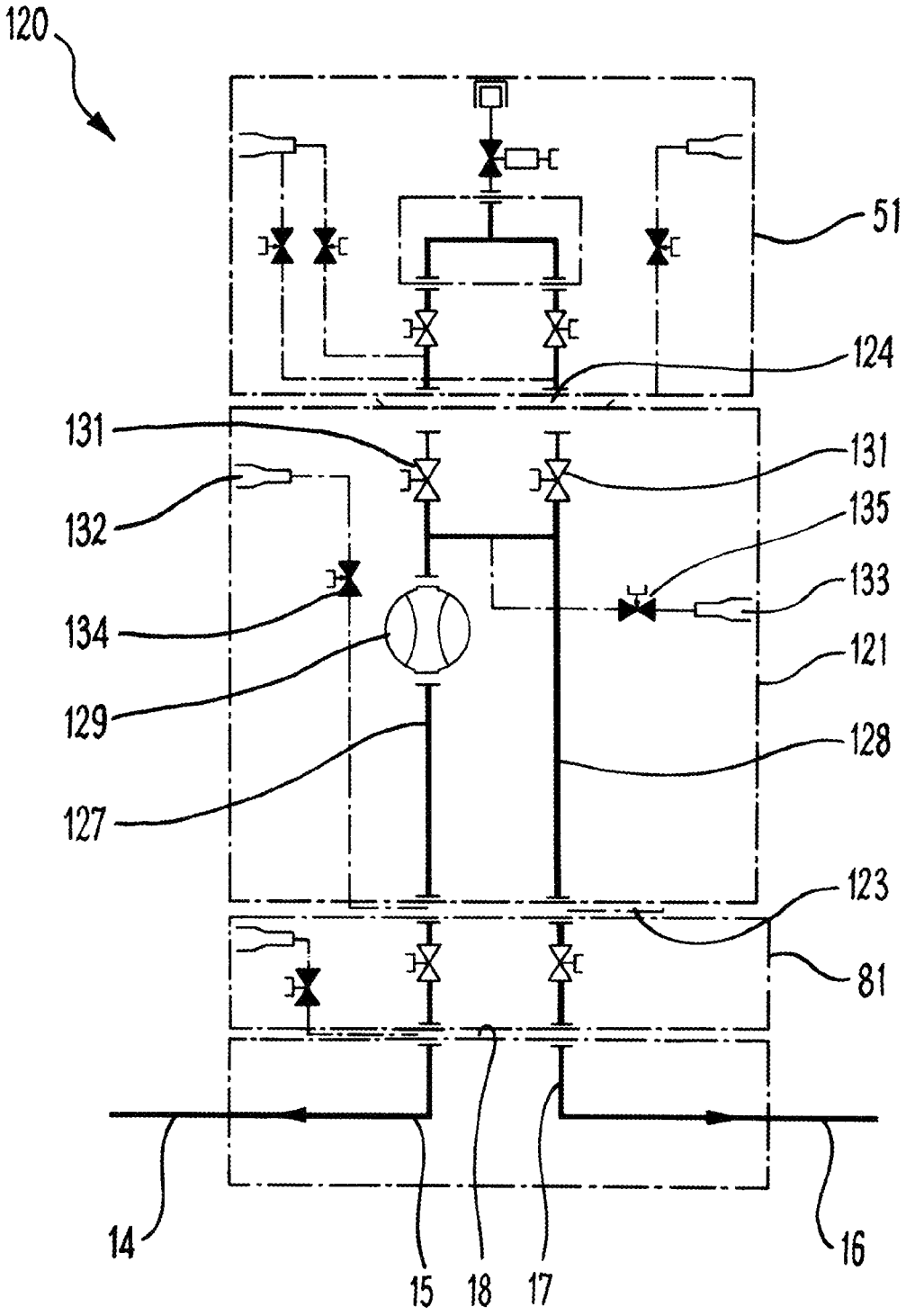
FIG. 8 is a schematic process and instrumentation diagram of the assembly of FIG. 7.

As shown in FIG. 8, the module 121 comprises first and second flow lines 127, 128, which connect to the bores 15, 17 of the flow access interface 18 via the valve skid 81. Flow line 127 comprises a flow meter 129, and flow line 128 provides a return path to the bore 117. ROV actuated valves 131 are provided in line between the flow access interface 118 and the upper interface 124. ROV hot stab connectors 132, 133 are provided in the module along with ROV operated valves 134, 135, and together enable controlled provision of hydraulic or system fluids, for example for flushing of internal lines.

By providing the module 121 with an upper interface, the module can be used in a stacked configuration with a variety of different modules to provide a flexible subsea intervention system. In the configuration shown in FIGS. 7 and 8, the scale squeeze module 51 is stacked on the top of the module 121, and is in fluid communication with the flow lines 14, 16 via the flow lines 127, 128. The scale squeeze operation may be performed with the module 121 in situ.

It will be appreciated that the modules can be used in alternative stacked configurations, and FIGS. 9A to 9G show schematically a number of example assemblies. In each case, the assembly is formed on a flow access apparatus 151, which is configured for multi-bore access to a pair of production wells (not shown) via four flow paths or bores. It will be appreciated that the same stacked configurations shown in FIGS. 9A to 9G can be used with alternative multi-bore configurations.

The apparatus 151 comprises a flow access interface 152 which defines openings to the flow paths 153, 154, 155, 156. Bores 153, 154 are connected to a production bore and a flow line of a first well, and bores 155, 156 are connected to a production bore and a flow line of a second well. Valves 157, 158 enable selective cross-over between the flow lines.

In each case, the assembly is shown with an intermediate valve skid 160, which is similar to the valve skid 81 and comprises isolation valves 161 in line between the flow access interface 152 and the process modules. It will be appreciated that similar stacked configurations may be used with the valve skid omitted, for example if the site has isolation incorporated in the subsea infrastructure, or if the flow access apparatus has integrated isolation valves.

FIG. 9A shows an assembly 170 comprising an apparatus 150, a valve skid 160, and a pair of multiphase flow meter process modules 171 mounted in parallel configuration on the apparatus. The assembly 170 enables, for example, simultaneous flow metering of a pair or production bores from a single assembly. Alternatively, or in addition, the system provides redundancy and/or the ability to selectively meter flow through the respective flow lines from a common site. The flow meter process modules are provided with upper interfaces which facilitate the stacking of further process modules on the assembly if desired.

FIG. 9B shows an assembly 180 comprising an apparatus 150, a valve skid 160, and a pair of sampling process modules 181 mounted in parallel configuration on the apparatus. The assembly 180 enables, for example, simultaneous fluid sampling of a pair or production bores from a single assembly. Alternatively, or in addition, the system provides redundancy and/or the ability to selectively sample fluid from the respective flow lines from a common site.

FIG. 9C shows an assembly 190 comprising an apparatus 150, a valve skid 160, and a scale squeeze process module 191 mounted on the apparatus. An injection hose termination device 192 is connected to a flow connector of the module 191. The assembly 191 enables, for example, simultaneous injection of fluids to a pair or production bores from a single assembly. Alternatively, or in addition, the system provides redundancy and/or the ability to selectively perform scale squeeze operations on the respective wells from a common site.

FIG. 9D shows an assembly 200 comprising an apparatus 150, a valve skid 160, and a scale squeeze process module 201 mounted on the apparatus in parallel with a multiphase flow metering module 171. The flow meter process module 171 is provided with an upper interface to facilitate the stacking of further process modules on the assembly if desired.

FIG. 9E shows an assembly 210 comprising an apparatus 150, a valve skid 160, and a sampling process module 181 mounted on the apparatus in parallel with a multiphase flow metering module 171. The flow meter process module 171 is provided with an upper interface to facilitate the stacking of further process modules on the assembly if desired.

FIG. 9F shows an assembly 220 comprising an apparatus 150, a valve skid 160, and a sampling process module 181 mounted on the apparatus in parallel with a scale squeeze process module 201.

FIG. 9G shows an assembly 230 comprising an apparatus 150, a valve skid 160, and a scale squeeze process module 201 mounted on the apparatus in parallel with a multiphase flow metering module 171. The flow metering process module 171 is provided with an upper interface, and a fluid sampling module 181 is connected in series with the flow metering module 171.

The foregoing are examples of stacked module configurations in accordance with embodiments of the present invention, but it will be appreciated that principles of the invention enable a wide range of series and/or parallel configurations of modules to be configured according to operational requirements.

Figure 10:
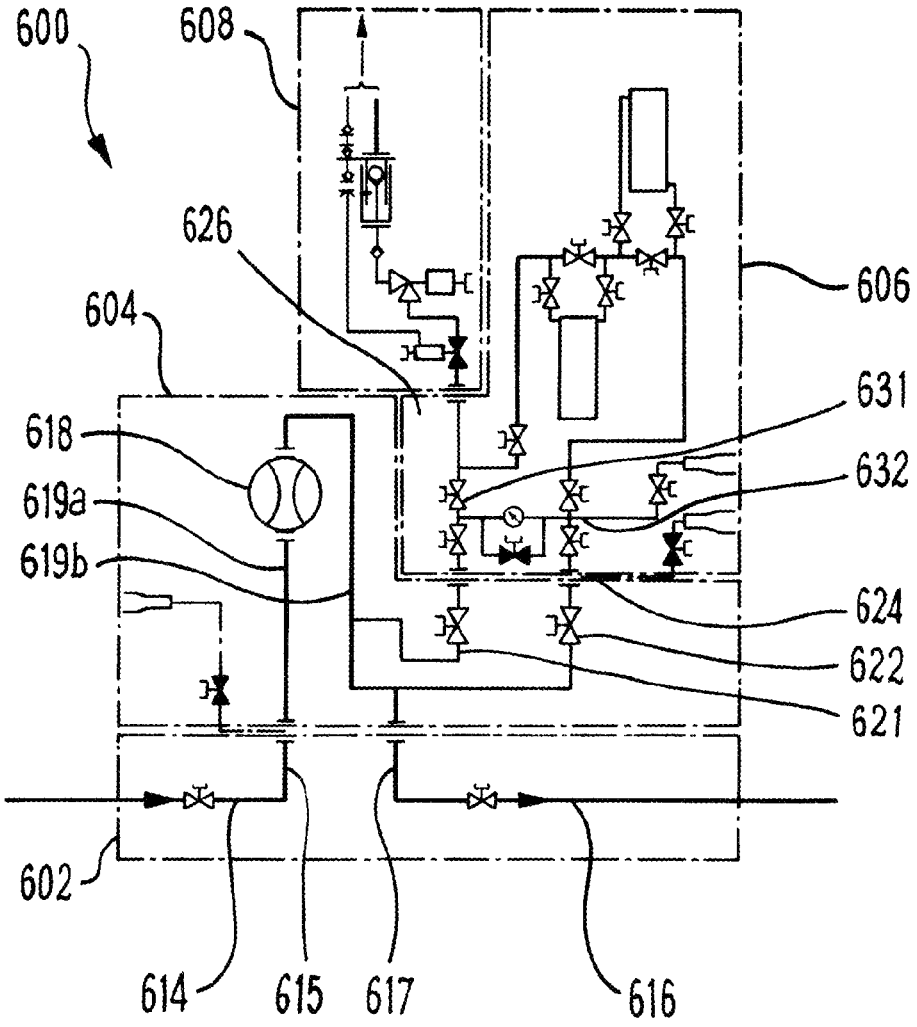
FIG. 10 is a schematic process and instrumentation diagram of an assembly according to yet a further, preferred alternative embodiment of the invention.

In an alternative embodiments of the invention, combinations of modules similar to those shown in FIGS. 9A to 9G are provided on a flow access apparatus with a dual bore configuration, comprising two flow access bores. An example embodiment of such a combination is shown schematically at FIG. 10. In FIG. 10, an assembly, generally depicted at 600, comprises a dual bore flow access apparatus 602, a multiphase flowmeter process module 604, a sampling process module 606, and an injection module 608. The flow access interface module provides dual bore access to the subsea production flow system via flow bores 614, 616.

Flow access bore 615 connects the production flow to the multiphase flowmeter 618 via flowline 619*a*, and flowline 619*b* returns production fluid to the access bore 617. In a metering mode, production flow is passed through the flowlines 619*a* and 619*b* and flowmeter 618 and returned to the production flowline 616.

In this embodiment, the flow metering module 604 is connected in series with the fluid sampling module 606. Flowlines 621, 622, lead to an upper metering module interface 624. Connected to the upper metering module interface 624 is the sampling module 606. Sampling flowlines 631, 632 connect to the flowlines 621, 622, and lead to a sampling circuit.

The injection module 608 is also mounted in series with the flow metering module 604, with a flowline which bypasses the sampling module 606 to an upper interface 626 of the sampling module 606. Injection module 608 enables a subsea injection operation, and in particular a well scale and squeeze operation, to be performed by delivering injection fluid from a hose to the production bore via the sampling flowline 631, the flowline 619*a*, and the flow bore 614. It will be appreciated that in an alternative embodiment, the injection and sampling functions of the system may be performed by a single, combined injection and sampling module, rather than the two separate modules shown in FIG. 10.

The configuration of FIG. 10 has the advantage of a combination of three functional modules on dual bore flow access apparatus.

Figure 11:
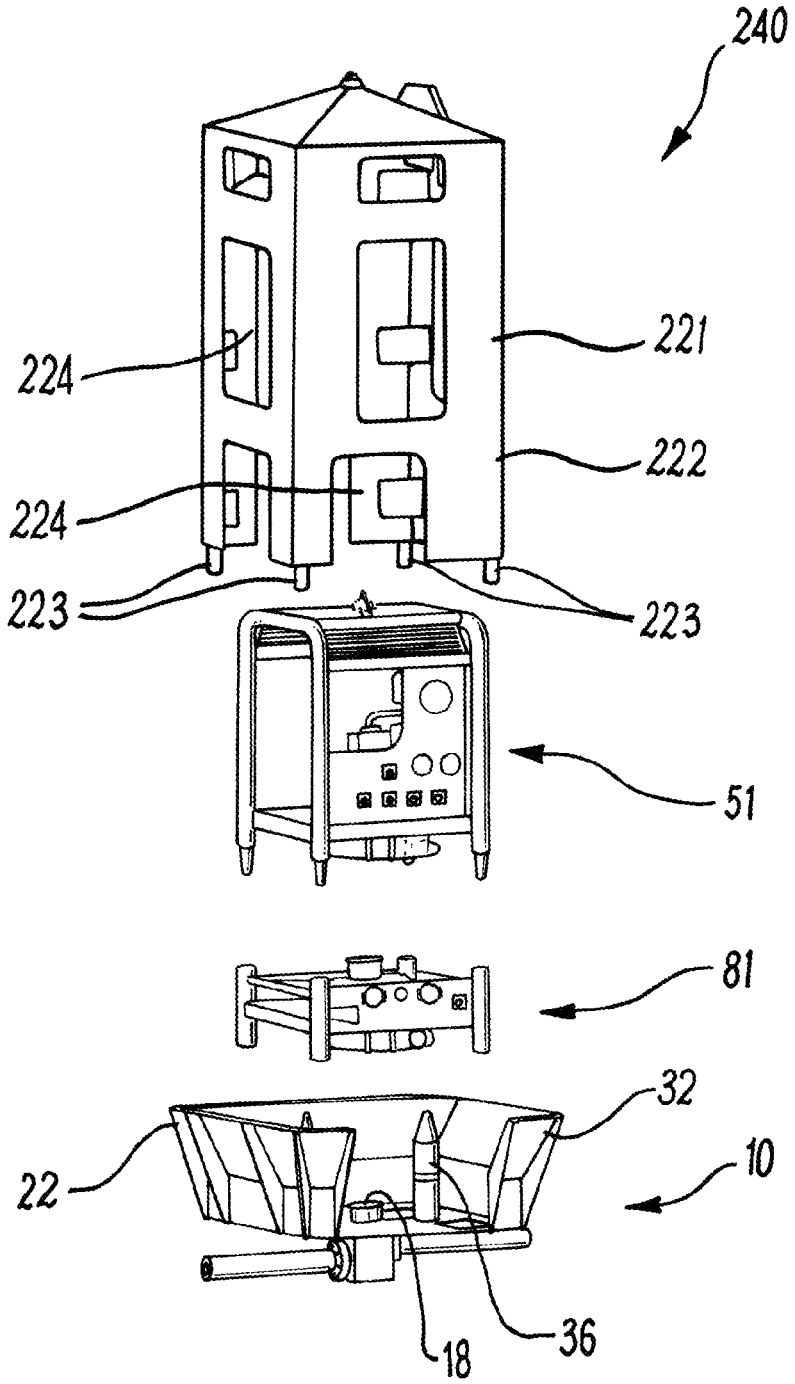
FIG. 11 is an isometric view of an assembly and running tool according to a further alternative embodiment of the invention.

FIG. 11 is an exploded isometric view of a system 240 comprising an assembly and running tool according to a further alternative embodiment of the invention. The assembly comprises an apparatus 10, as described with reference to FIGS. 1A and 1B, a valve skid 81, and a process module 51. A running tool 221 comprises a frame 222 that defines an internal volume designed to accommodate one or more of the process modules. The running tool is configured to be deployed by a flexible or rigid conveyance, with the aid of an ROV or diver, to the landing site, where it is guided onto the flow access apparatus 10 with the assistance of the guide structure 22. The running tool comprises feet 223 to enable it to land softly on the flow access apparatus 10. Side apertures 224 in the frame of the running tool enable access to the modules so that they may be connected to the apparatus. The running tool may be used in reverse to retrieve process modules from the flow access apparatus 10, for example when operations have been completed, for change out, or to perform maintenance operations.

It should be noted that the valve skid 81, although shown separated from the module 51, may be deployed from surface and landed on the flow access apparatus 10 together with and connected to the module 51.

Figure 12:
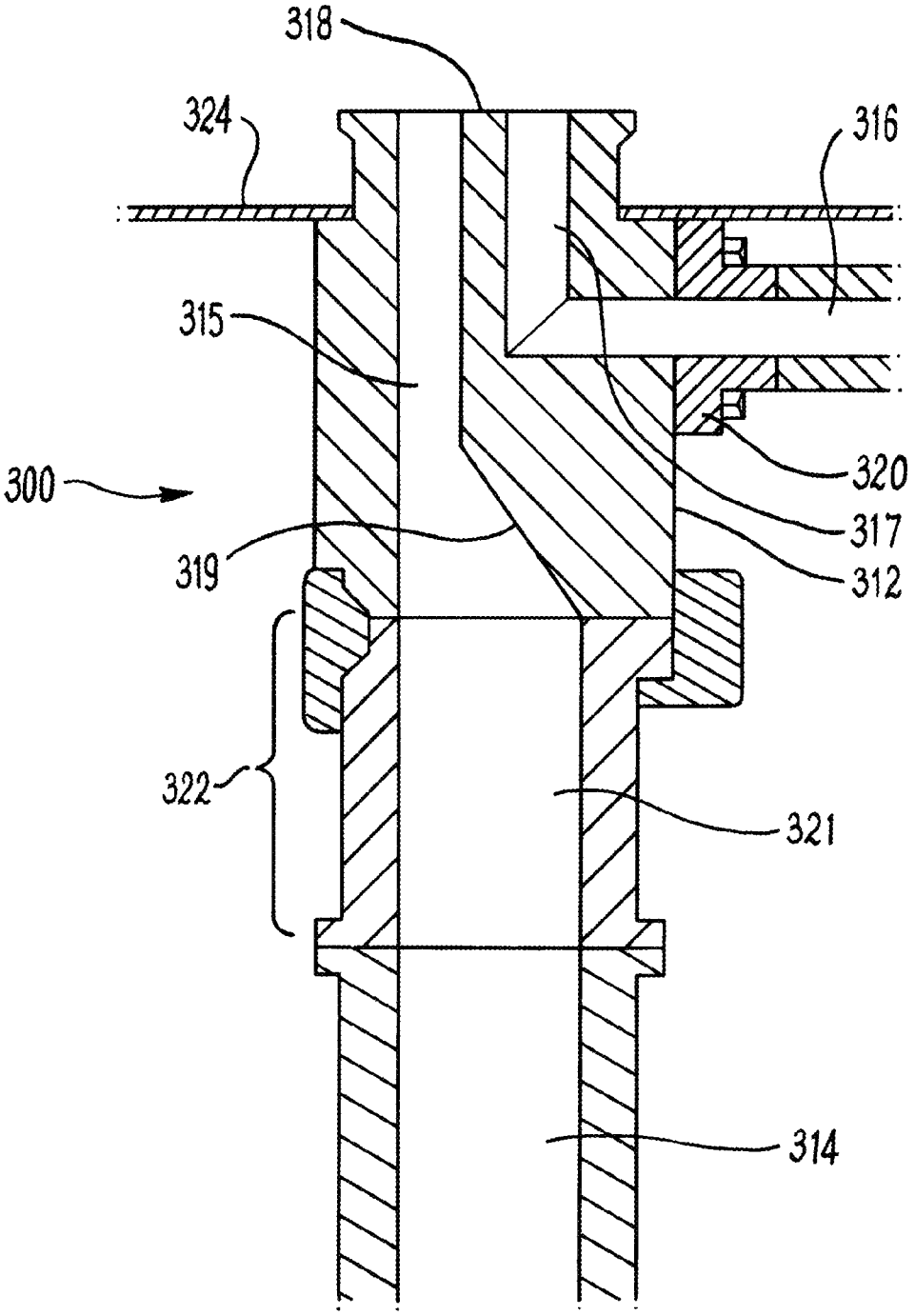
FIG. 12 is a schematic, sectional view of a flow access apparatus according to a further embodiment of the invention.

In foregoing embodiments of the invention, the multibore flow access apparatus is shown connected to a horizontal production flowline 14. However, it will be appreciated that the principles of the invention may be used to connect to vertical flowlines such as industry standard tree connectors. An example embodiment of such a configuration is shown schematically in FIG. 12. In FIG. 12, the flow access apparatus, generally depicted at 300, comprises a body 312 which is connected to first and second flowlines 314 and 316 to the flow access apparatus. The body 312 extends through an opening in a baseplate 324, and defines an upward facing flow access interface 318.

In this embodiment, the first flowline 314 is vertical, and the body 312 is connected to the flowline by an industry standard tree connector 322. The body 312 defines a first flow access bore 315 which provides a flow path between the connector 322 and the flow access interface 318. At its lower end, the first flow access bore 315 is continuous with the bore 321 of the connector 322, and comprises a reducing section, shown generally at 319. The reducing section acts to step down the flowline diameter between the connection of the connector bore 321 and the first flow access bore 315.

The body also defines a second flow access bore 317 providing a flow path between the flow access interface 318 and a second connector 320. The connection between the second flowline 316 and the body 312 is made up by flange connector 320.

The vertical connector 322 may be of a number of different types, including tree connectors which require the use of running tools as well as those which do not. Although, the bore 321 of the connector 322 and the first flow access bore 315 are eccentric, it should be appreciated that concentric arrangements may be provided in other embodiments of the invention.

The configuration of FIG. 12 is advantageous as vertical tree connector 322 will typically have a large load bearing capacity, which will enable it to provide additional support for the vertical loads associated with the functional multi-process modules assembled on the flow access apparatus.

The invention provides an apparatus and system for accessing a flow system (such as a subsea tree) in a subsea oil and gas production installation, and method of use. The apparatus comprises a body and a plurality of connectors configured to connect the apparatus to the flow system. A flow access interface is provided on the body for connecting the apparatus to a subsea process apparatus, and the body defines a plurality of flow paths. Each flow path fluidly connects one of the plurality of connectors to the flow access interface to provide an intervention path from a connected subsea process apparatus to the flow system in use. Aspects of the invention have particular application to flow metering, fluid sampling, and well scale squeeze operations.

Embodiments of the invention provide a range of flow access solutions which facilitate convenient intervention operations. These include fluid introduction for well scale squeeze operations, well kill, hydrate remediation, and/or hydrate/debris blockage removal; fluid removal for well fluid sampling and/or well fluid redirection; and/or the addition of instrumentation for monitoring pressure, temperature, flow rate, fluid composition, erosion and/or corrosion. Other applications are also within the scope of the invention.

It will be appreciated that the invention facilitates access to the flow system in a wide range of locations. These include locations at or on the tree, including on a tree or mandrel cap, adjacent the choke body, or immediately adjacent the tree between a flow line connector or a jumper. Alternatively the apparatus of the invention may be used in locations disposed further away from the tree. These include (but are not limited to) downstream of a jumper flow line or a section of a jumper flow line; a subsea collection manifold system; a subsea Pipe Line End Manifold (PLEM); a subsea Pipe Line End Termination (PLET); and/or a subsea Flow Line End Termination (FLET).

Various modifications may be made within the scope of the invention as herein intended, and embodiments of the invention may include combinations of features other than those expressly described herein.

What is claimed:

1. A flow access apparatus for a flow system in a subsea oil and gas production installation, the flow access apparatus comprising:

a body;

a plurality of connectors configured to connect the flow access apparatus to the flow system; and a flow access interface for connecting the flow access apparatus to a subsea process apparatus;

wherein the flow access interface provides a single connection point and/or landing point for the subsea process apparatus;

wherein the body defines a plurality of flow paths, and each flow path fluidly connects one of the plurality of connectors to the flow access interface to provide an intervention path from a connected subsea process apparatus to the flow system in use; and wherein the flow access apparatus is configured to be disposed between a flow line connector for a jumper flow line and the jumper flow line to provide an access point for the flow system and an access point to the jumper flow line from the connected subsea process apparatus in use.

2. The apparatus according to claim 1, wherein the flow access interface comprises a plurality of flow access openings in a unitary connector, and wherein each of the plurality of flow access openings corresponds to a respective flow path through the flow access apparatus.

3. The apparatus according to claim 2, wherein the unitary connector comprises a unitary face or plate with the plurality of flow access openings formed therein.

4. The apparatus according to claim 1, wherein the flow access interface is configured be connected to the subsea process apparatus for fluid intervention, the subsea process apparatus being configured to perform at least one function selected from a group comprising fluid sampling, fluid diversion, fluid recovery, fluid injection, fluid circulation, fluid measurement and/or fluid metering.

5. The apparatus according to claim 1, wherein the body of the flow access apparatus comprises a pair of flow paths or bores, and the flow access apparatus comprises a dual bore apparatus.

6. The apparatus according to claim 1, wherein the body of the flow access apparatus comprises a plurality of flow paths greater than two, and wherein the flow paths are configured to connect multiple subsea wells to the subsea process apparatus in use.

7. The apparatus according to claim 1, wherein a first connector of the plurality of connectors of the flow access apparatus is configured to be connected to an external opening on the flow system.

8. The apparatus according to claim 7, wherein the flow system comprises a subsea tree, and the external opening is downstream of a wing valve of the subsea tree.

9. The apparatus according to claim 7, wherein the external opening comprises the flow line connector for the jumper flow line.

10. The apparatus according to claim 1, wherein a second connector of the plurality of connectors of the flow access apparatus is configured for connecting the flow access apparatus to a downstream jumper flow line.

11. The apparatus according to claim 1, wherein the flow access apparatus is disposed on a subsea tree connector.

12. A subsea oil and gas production installation comprising:

a subsea well and a subsea flow system in communication with the subsea well, the subsea flow system comprising a jumper flow line; and a flow access apparatus;

wherein the flow access apparatus comprises:

a body;

a plurality of connectors configured to connect the flow access apparatus to the subsea flow system; and a flow access interface for connecting the flow access apparatus to a subsea process apparatus;

wherein the flow access interface provides a single connection point and/or landing point for the subsea process apparatus;

wherein the body defines a plurality of flow paths, and each flow path fluidly connects one of the plurality of connectors to the flow access interface to provide an intervention path from a connected subsea process apparatus to the subsea flow system in use; and wherein the flow access apparatus is disposed between a flow line connector for a jumper flow line and the jumper flow line to provide an access point for the subsea flow system and an access point to the jumper flow line from the connected subsea process apparatus in use.

13. The installation according to claim 12, further comprising the subsea process apparatus connected to the flow access interface.

14. The installation according to claim 13, wherein the subsea process apparatus comprises a fluid intervention apparatus, and wherein the fluid intervention apparatus is configured to perform at least one function selected from a group comprising fluid sampling, fluid diversion, fluid recovery, fluid injection, fluid circulation, fluid measurement and/or fluid metering.

15. A method of performing a subsea intervention operation, comprising:

providing a subsea well and a subsea flow system in communication with the subsea well, the subsea flow system comprising a jumper flow line;

providing a flow access apparatus on the subsea flow system, the flow access apparatus comprising:

a body;

a plurality of connectors, and a flow access interface for connecting the flow access apparatus to a subsea process apparatus;

wherein the flow access interface provides a single connection point and/or landing point for the subsea process apparatus;

wherein the body defines a plurality of flow paths, and each flow path fluidly connects one of the plurality of connectors to the flow access interface; and wherein the flow access apparatus is disposed between a flow line connector for a jumper flow line and the jumper flow line to provide an access point for the subsea flow system and an access point to the jumper flow line from a connected subsea process apparatus;

providing the subsea process apparatus on the flow access interface; and accessing the subsea flow system via an intervention path formed through one of the plurality of flow paths defined by the body to one of the plurality of connectors.

16. The method according to claim 15, wherein the method comprises performing at least one of fluid sampling, fluid diversion, fluid recovery, fluid injection, fluid circulation, fluid measurement and/or fluid metering.

17. The method according to claim 16, wherein the method comprises performing a well scale squeeze operation.

18. The method according to claim 16, wherein the method comprises performing a well fluid sampling operation.

19. The method according to claim 15, comprising connecting the flow access apparatus to the subsea flow system at a location selected from a group consisting of: a jumper flow line connector; downstream of a jumper flow line or a section of the jumper flow line; Christmas tree; a tree connector; a subsea collection manifold system; a subsea Pipe Line End Manifold (PLEM); a subsea Pipe Line End Termination (PLET); and a subsea Flow Line End Termination (FLET).

20. The method according to claim 15, wherein the flow access apparatus is pre-installed on the subsea flow system and left in situ at a subsea location for later performance a subsea intervention operation.

* * * * *